United States Patent [19]

Pawlikowski et al.

[11] Patent Number: 4,524,298

[45] Date of Patent: Jun. 18, 1985

[54] COLOR CATHODE RAY TUBE INCORPORATING IMPROVED THERMAL COMPENSATION TYPE APERTURE MASK SUPPORTING MEANS

[75] Inventors: Stanley L. Pawlikowski, Seneca Falls; Richard A. Tamburrino, Auburn, both of N.Y.

[73] Assignee: North American Philips Consumer Electronics Corp., New York, N.Y.

[21] Appl. No.: 510,496

[22] Filed: Jul. 5, 1983

[51] Int. Cl.[3] ..... H01J 29/81

[52] U.S. Cl. ..... 313/405; 313/406

[58] Field of Search ..... 313/404, 405, 406

[56] References Cited

U.S. PATENT DOCUMENTS

| | | | |
|---|---|---|---|
| 3,617,787 | 11/1971 | Plukker et al. | 313/405 |
| 3,898,508 | 8/1975 | Pappadis et al. | 313/405 |
| 4,012,661 | 3/1977 | Danielson, Jr. et al. | 313/405 |

*Primary Examiner*—William Smith

*Attorney, Agent, or Firm*—Thomas A. Briody; Jack Oisher; John C. Fox

[57] ABSTRACT

An improved bimetal mounting bracket for color cathode ray tubes allows an increase in the space between the mask and screen of the tube to accommodate a miniaturized electron gun without the need for changes to the other tube components.

2 Claims, 6 Drawing Figures

COLOR CATHODE RAY TUBE INCORPORATING IMPROVED THERMAL COMPENSATION TYPE APERTURE MASK SUPPORTING MEANS

BACKGROUND OF THE INVENTION

This invention relates to a color cathode ray tube incorporating means for supporting an aperture mask therein, and more particularly relates to such a tube incorporating an improved thermal compensation type of mask supporting means for higher Q-spacing.

Most color cathode ray tubes (CCRTs) employ "aperture masks", that is, color selection electrodes of formed thin metal sheets having a multitude of apertures positioned to allow each of the three electron beams to strike only on set of the three primary (red, blue and green) color-emitting phosphor elements on the screen. The thin aperture mask is supported within the tube by a relatively massive and rigid frame, which in turn is supported in the tube by the engagement of frame brackets with mounting studs protruding from the sidewall of the glass viewing panel.

Most of the electron beams emitted from the electron gun never reach the phosphor elements on the screen, but instead are intercepted by the aperture mask and the electron shield between the mask frame and the panel sidewalls. It is estimated that only about 15% of the electron beams actually are transmitted through the mask to the screen. Thus, a large amount of electron beam energy is dissipated as heat within the tube The apertured portion of the mask has a contoured surface of roughly spherical shape, corresponding in general to the screen contour on the interior surface of the viewing panel. The space between the aperture mask and the screen is commonly referred to as the "Q-space". Maintaining this Q-space during tube operation is critical in order to maintain registration between the scanning electron beams and the phosphor elements on the screen.

During initial warmup, the heat generated by the electron beams striking the aperture mask causes the mask to expand laterally due to its relatively low mass, high thermal conductivity and high thermal expansion coefficient. This expansion tends to displace the aperture in a direction away from the center of the mask and toward the edges of the mask. After a short time the mask frame also expands bringing the components toward equilibrium. However, because the apertures are now displaced further from the center of the mask, the Q-space must be reduced in order to restore registration between the mask apertures and the phosphor elements on the screen.

Bimetallic element have been incorporated into the mask frame support means to cause the mask frame assembly to move toward the screen during initial tube warmup, thus reducing Q-space to compensate for mask expansion, and maintaining registration during tube operation. See, for example, U.S. Pat. No. 3,524,973.

A successful application of bimetal design to obtain thermal compensation utilizes two relatively narrow elongated dissimilar metal elements joined edge to edge along their length dimensions to form an elongated bimetal spring bracket. One end of this bracket is fixed to the mask frame sidewall, and the other end is apertured to engage mounting studs protruding from the glass panel sidewall. One of the elements is L-shaped to provide a tab at the free end to accommodate the aperture. The aperture is in the shape of an equi-lateral triangle with rounded apexes, and is oriented with one base normal to the bimetal joint.

These bimetal spring brackets are formed to extend outwardly from the frame sidewall toward the panel sidewall. This outward spring bias of the brackets necessitates flexing them inwardly during insertion of the mask-frame assembly into the panel, and serves to maintain firm contact with the panel studs during tube operation.

Recent trends toward compaction of the color cathode ray tube and its components have led to the "mini-neck" design, in which the inline electron gun is miniaturized to fit into a rube neck which has been reduced to about 22 millimeters in diameter from 29 millimeters (narrow neck) and 36 millimeters (standard neck) diameters. Such design results in savings both in material and in the power needed to deflect the electron beams during TV operation.

Unfortunately, the design also results in a significantly larger Q-space, due to the closer spacing of the three inline electron beams in the gun. One way of achieving such increased Q-space is to locate the panel studs farther back from the screen on the panel sidewall. However, this approach requires creation of a non-standard panel type, complicating manufacture and reducing the ability to recycle scrap. Another way of increasing Q-space is to weld the brackets closer to the screen side of the frame sidewall. However, in current designs, this would require removal of a portion of the mask sidewall or skirt which telescopes over the outside of the frame sidewall, and is needed to maintain adequate mask strength.

Accordingly, it is an object of the present invention to provide a color cathode ray tube with an improved mask support means that will enable achievement of the Q-space required for compact tubes such as "mini-neck" tubes, while also providing the desired temperature compensation for such tubes. It is also an object of the invention to achieve increased Q-space in color cathode ray tubes without moving the mounting studs in the face panel, and without removing any portion of the mask skirt. It is also an object of the invention to achieve increased Q-space with minimum change to the color cathode ray tube.

SUMMARY OF THE INVENTION

In accordance with the invention, it has been found that higher Q-spacing may be readily achieved by using improved bimetallic spring type thermal compensation supporting brackets for mask-frame assemblies in color cathode ray tubes. The improved bracket comprises two relatively narrow elongated rectangular elements of dissimilar metals joined edge to edge along their length dimensions to form an elongated rectangular bimetallic spring. An aperture in the shape of an equilateral triangle with rounded apexes is oriented to bridge the bimetal joint. The aperture is also oriented to have one base of the triangle parallel to the bimetal joint, thereby allowing adequate space between the length edges of the bracket and the aperture for needed mechanical strength. The improved brackets are mounted on the sidewall of the aperture mask frame of the color cathode ray tube at an angle to the frame's edge to achieve the desired Q-space between the mask and screen of the tube.

DESCRIPTION OF THE PREFERRED EMBODIMENT

For a better understanding of the present invention, together with other and further objects, advantages and capabilities thereof, reference is made to the following disclosure and appended claims in conjunction with the accompanying drawings.

Figure 1:
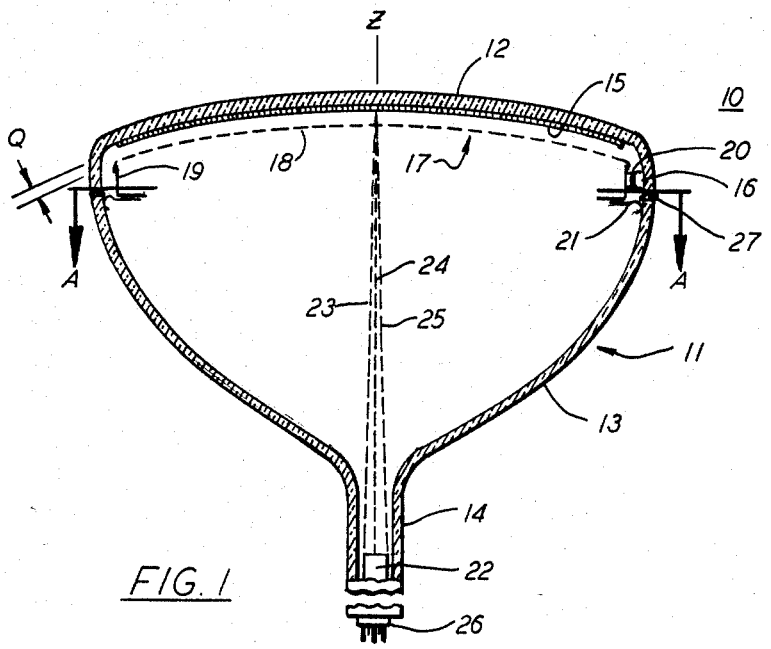
FIG. 1 is a section view of a typical color cathode ray tube taken along the inline plane L thereof.

Referring now to FIG. 1, there is shown a section view of a typical color cathode ray tube representative of the present state of the art. The section is taken along the inline plane, that is, the plane formed by the three inline beams of the electron gun when they are focused to converge at a spot in the center of the screen. The tube 10 comprises a glass envelope 11 having face panel 12, funnel 13, and neck 14. A phosphor screen 15 disposed on the interior surface of face panel 12 is composed of a pattern of individual elements of red, blue and green-emitting phosphors. Mounting studs 16 protrude from the sidewalls of the face panel 12. Mask-frame assembly 17 is composed of mask 18, frame 19 and frame brackets 20, which engage mounting studs 16. Mask 18 is positioned adjacent to screen 15 by a distance Q which is commonly referred to in the art as the Q-space. Electron gun 22 located in the rear portion of neck 14 emits electron beams 23, 24 and 25, portions of which pass through mask 18 to strike the phosphor screen 15. Electrical connection is provided through connecting pins in base 26. Electron shield 21 prevents stray electrons from entering the screen area by passing between the sidewalls of the mask-frame assembly and the panel.

Figure 2A:
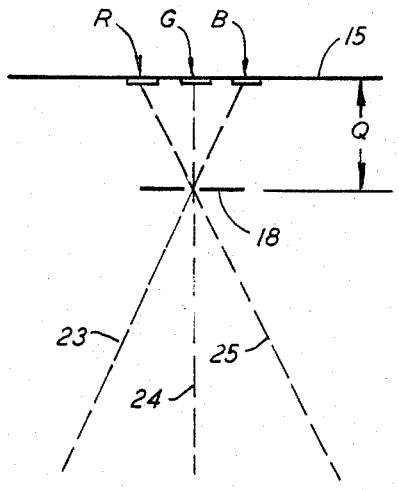
FIG. 2 is a diagram of a portion of the tube of FIG. 1.
Figure 2B:
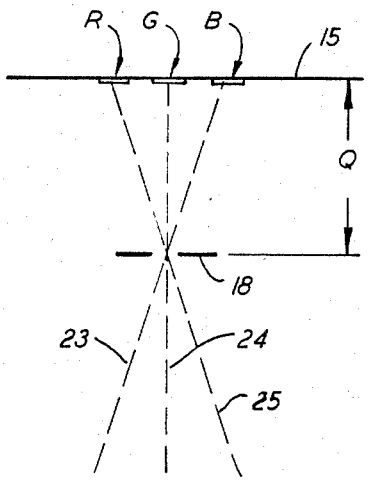

Referring now to FIGS. 2*a* and 2*b*, there are shown diagrams of enlarged central portions of the aperture mask and screen with the three electron beams 23, 24 and 25 passing through an aperture of mask 18 to converge at screen 15. The distance between mask 18 and screen 15 is the Q space. The beams 23, 24 and 25 are shown to enter from exaggerated angles to emphasize the effect of reducing the distance between the three electron guns from the narrow neck spacing of FIG. 2*a* to the mini-neck spacing of FIG. 2*b*. It may readily be appreciated that as the electron guns are spaced closer together, and the three beams enter at smaller angles relative to one another, the mask 18 must be moved further away from screen 15 in order to allow the beams to strike the red, green and blue phosphor elements on the screen. Thus, Q space must be increased.

Figure 3:
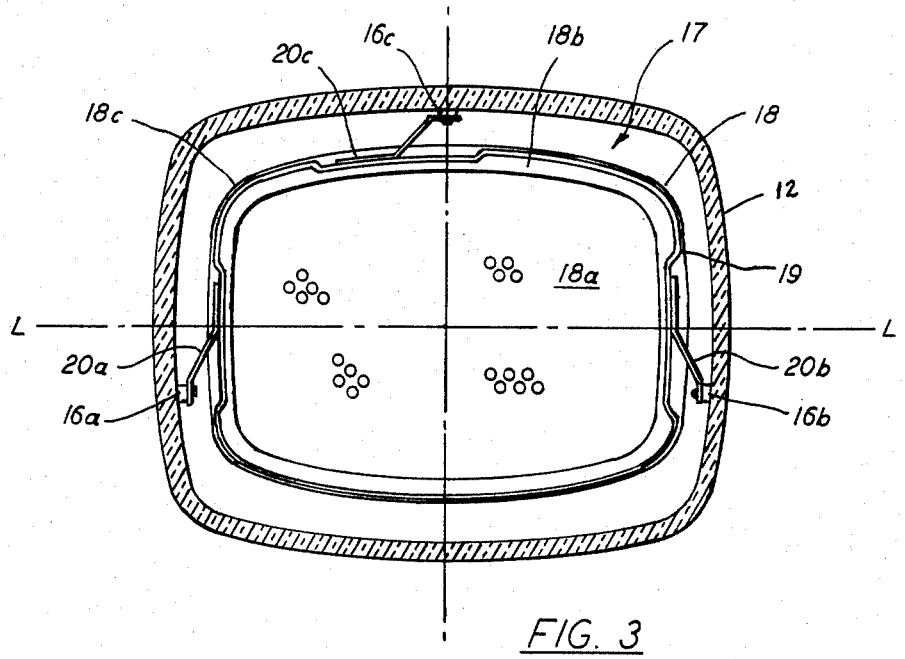
FIG. 3 is a section view taken along the line A—A of FIG. 1.

FIG. 3 is a section view taken along line A—A of FIG. 1 and affords a rear view of the mask panel assembly 30, wherein mask frame assembly 17 is supported within face panel 12 by means of mask frame brackets 20*a*, 20*b*, and 20*c* engaging panel studs 16*a*, 16*b* and 16*c*. It will be seen that brackets 20*a*, *b* and *c* are formed to extend outward toward the face panel sidewall. In the positions shown, these brackets are flexed inwardly from their normal resting positions, so that there is an outward spring bias against the studs to provide secure engagement therewith.

Figure 4:
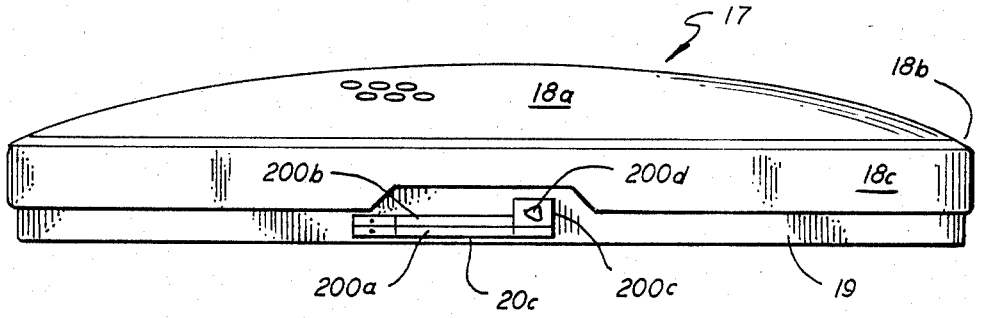
FIG. 4 Prior Art
FIG. 4 is a side view of a mask frame assembly using a prior art support bracket.

FIG. 4 is a side view of mask frame assembly 17 showing a prior art bracket affixed to the sidewall of mask frame 19. Bracket 20*c* is composed of bimetal strips 200*a* and 200*b* which are joined edge to edge along their length dimensions. Element 200*a* is of a lower thermal expansion metallic composition than is element 200*b*, so that during initial warmup of the tube, bracket 20*c* tends to deflect in the direction away from the viewing screen, thus moving mask frame assembly 17 toward the viewing screen and decreasing Q. Bimetal strip 200*b* is L-shaped to provide tab portion 200*c* containing an aperture 200*d*. Mask skirt 18*c* is contoured adjacent bracket 20*c* to expose a portion of mask frame sidewall 19 and to provide clearance between bracket 20*c* and skirt 18*c*. This clearance is critical because during tube fabrication, the mask-frame assembly must be repeatedly inserted and extracted from the glass viewing panel. Such repeated insertion and extraction is necessitated by the fact that the apertured portion 18*a* of the mask 18 is used as a negative in a photolithographic process for forming the pattern of phosphor elements on the screen. Because of the importance in obtaining registration between the three electron beams and the phosphor elements on the screen, and because of uncontrollable variations in the manufacturing process from one tube to another, the mask and screened panel become "married", that is, they proceed together through the remainder of the manufacturing process to the finished tube. It will thus be appreciated that once the screening process has begun, any damage to the mask would result in rejection not only of the mask but also the panel. It is thus important to safeguard against any damage to the relatively fragile aperture mask throughout the manufacturing process. If there were any interference between the brackets and the mask skirt during insertion or extraction which resulted in impingement of the brackets upon the mask skirt, damage to and rejection of the mask could result.

Figure 5:
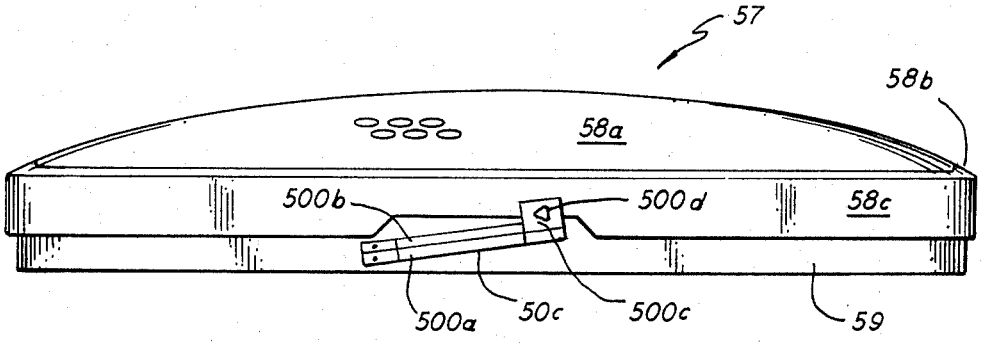
FIG. 5 is a side view of a mask frame assembly in which the bracket of FIG. 4 has been remounted.

FIG. 5 demonstrates the dilemma presented to the tube designer who must increase Q space without making major design changes to the tube. Mounting the bracket 50*c* at a greater angle to the edge of mask frame 59 than had been necessary in the prior art arrangement of FIG. 4 would result in significant overlap between the tab portion 500*c* of the bracket and the mask skirt 58*c*. Recontouring the mask skirt 58*c* to avoid such overlap would result in serious mechanical weakening of an already fragile tube component.

Figure 6:
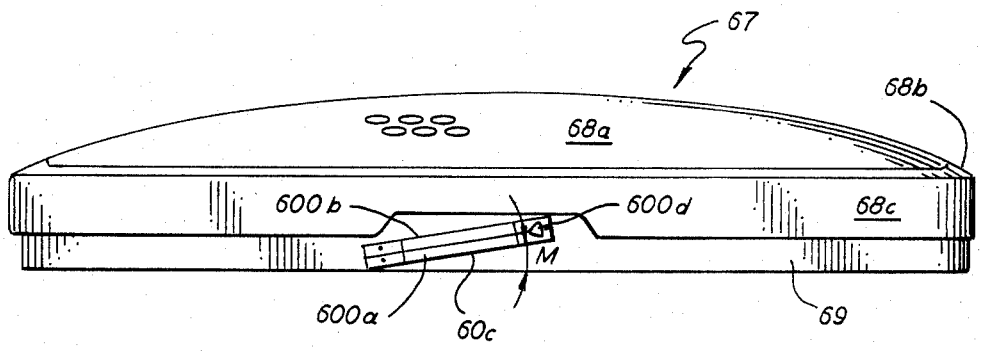
FIG. 6 is a side view of a mask frame assembly using a support bracket in accordance with the present invention.

FIG. 6 shows the arrangement of the invention in which rectangular bracket 60*c*, comprised of rectangular elements 600*a* and 600*b*, contains aperture 600*d* which is located to bridge the bimetallic joint between elements 600*a* and 600*b*. In addition, the triangular-shaped aperture 600*d* is oriented to have one of its bases parallel to the bimetallic joint. This orientation enables optimum placement of the aperture to retain as much material between the long edges of the bracket and the aperture. Bracket 60*c* may be mounted to frame 69 at an angle M sufficient to achieve the desired Q-space without interference between bracket 60*c* and mask skirt 68*c* during insertion and extraction.

A typical example compares a mini-neck color cathode ray tube of the invention with a narrow neck tube of the prior art both having a 13 inch (diagonal) screen.

| | S (beam spacing) (millimeters) | $Q_C$ (millimeters) | M (mounting angle) |
|---|---|---|---|
| MINI-NECK | 0.775 | 18.72 | 7.0° |
| NARROW NECK | 0.84 | 14.20 | 0.0° |

We claim:

1. A color cathode ray tube comprising: an evacuated glass envelope having face panel, funnel and neck portions; a phosphor screen on the interior surface of the face panel; an electron gun in the neck for directing three electron beams toward the screen; an aperture mask positioned adjacent the screen to direct the electron beams to desired phosphor elements on the screen, the mask having an apertured face portion and a sidewall portion; a supporting frame positioned inside and attached to the inner surface of the mask sidewall; a plurality of mounting studs protruding from the sidewall of the face panel; and a plurality of elongated mask supporting bimetal spring brackets, each having one end fixed to the sidewall of the mask frame and a free apertured end engaging a stud, each bracket comprising two relatively narrow elongated dissimilar metal elements joined edge to edge along their length dimension, with each aperture in the shape of an equilateral triangle with rounded apexes; the sidewall of the mask contoured to expose portions of the frame sidewall adjacent to the brackets and to allow clearance between the sidewalls of the mask and the brackets when deflected; characterized in that the brackets are each comprised of rectangular shaped elements, and further characterized in that the apertures in the brackets are oriented to bridge the bimetal joints with one base of each triangular-shaped aperture parallel to the bimetal joint; and further characterized in that the brackets are fixed to the sidewall of the mask frame at an angle to the edge of the mask frame sidewall to achieve a desired Q-space between the mask and screen, as well as to permit deflection of the bracket inwardly toward the mask frame sidewall without interference with the mask sidewall.

2. The color cathode ray tube of claim 1 in which the brackets are oriented at an angle of about 7.0° with respect to the edge of the mask frame sidewall.

* * * * *